US006085467A

United States Patent [19]

Packrall et al.

[11] Patent Number: 6,085,467

[45] Date of Patent: Jul. 11, 2000

[54] STACKABLE CASE TO TOWER CONVERSION

[75] Inventors: Timothy Packrall; Andrew Jay Burkette, both of Tampa, Fla.

[73] Assignee: Stellar Holdings, Inc., Tampa, Fla.

[21] Appl. No.: 09/123,942

[22] Filed: Jul. 28, 1998

Related U.S. Application Data

[60] Provisional application No. 60/054,115, Jul. 29, 1997.

[51] Int. Cl.[7] ..... E04B 1/343

[52] U.S. Cl. ..... 52/36.1; 52/236.7; 52/580; 52/589.1; 52/592.6

[58] Field of Search ..... 52/36.1, 580, 592.6, 52/589.1, 236.7; 446/116, 120, 124

[56] References Cited

U.S. PATENT DOCUMENTS

| | | | |
|---|---|---|---|
| 808,427 | 12/1905 | Barr . | |
| 2,604,959 | 7/1952 | Arbib . | |
| 2,892,340 | 6/1959 | Fort | 52/592.6 X |
| 3,698,149 | 10/1972 | Baker et al. | 52/592.6 X |
| 4,037,978 | 7/1977 | Connelly | 446/116 X |
| 4,043,086 | 8/1977 | Kaulfuss et al. | 52/36.4 X |
| 4,467,854 | 8/1984 | Godfrey . | |
| 4,979,554 | 12/1990 | Nelson . | |
| 5,382,087 | 1/1995 | Pouch . | |
| 5,421,112 | 6/1995 | Knorr . | |
| 5,439,043 | 8/1995 | Carter . | |
| 5,611,384 | 3/1997 | Carter . | |
| 5,758,466 | 6/1998 | Tucker | 52/36.1 X |

*Primary Examiner*—Christopher T. Kent
*Attorney, Agent, or Firm*—Hodgson, Russ, Andrews, Woods & Goodyear, LLP

[57] ABSTRACT

A stackable case to tower conversion for stacking shipping cases that are typically used for storing and transporting "pop-up" display structures for use at trade shows. The case to tower conversion provides a linking module for stacking cases one on top of the other. The linking module includes a plurality of walls, a plurality of projecting members, and a support member and is capable of engaging with the shipping cases to securely attach one case to another. The resulting tower can be used to form a part of the display and to support display panels or graphics.

9 Claims, 4 Drawing Sheets

STACKABLE CASE TO TOWER CONVERSION

CROSS REFERENCE TO RELATED APPLICATION

Applicants hereby claim priority based on Provisional Application Ser. No. 60/054,115 filed Jul. 29, 1997 and entitled "Stackable Case to Tower Conversion" which is incorporated herein by reference.

FIELD OF INVENTION

The present invention relates generally to expandable folding frame portable display structures, commonly referred to in the industry as "pop-ups" for use in trade shows, and relates specifically to an apparatus for stacking the cases for portable display structures.

BACKGROUND OF THE INVENTION

"Pop-Up" portable display structures are shown in U.S. Pat. No. 4,658,560 to Beaulieu, and U.S. Pat. Nos. 4,986,016 and 5,125,205 to Wichman. Such pop-up displays are available in a variety of either full-size freestanding configurations (such as 10 feet high curved, 8 feet high curved, and full-size flatwall) or small table-top configurations (such as 8 feet high table-top, 6 feet high table-top, and 6 feet high flatwall). The shipping cases used for storing and transporting the portable display structures are typically constructed of a durable, rigid, and preferably lightweight material such as plastic. Once the display structures are removed from the cases, the cases are typically stored somewhere in the trade show booth out of the view of the guests of the booth. With the well-known constraints on time and space that are associated with trade shows, there is a need to make better use of the shipping cases.

Accordingly, there is a need to provide the display purchaser with an option of using his shipping cases as a freestanding tower/kiosk unit by employing a center attachment mechanism, stacking the cases, and providing for a covering (or wrap) around the cases. Once set in place this tower/kiosk conversion could be used in conjunction with a header frame or as a freestanding unit within an exhibit space, demonstration area, or wherever the unit would likely be used. Such a header frame which can be used in conjunction with the tower/kiosk conversion is shown and described in our pending United States patent application Ser. No. 08/777,668 filed Dec. 20, 1996 entitled "Convertible Pop-Up Display Structure And Shipping Case Convertible To A Podium."

SUMMARY OF THE INVENTION

The present invention meets the above described needs by providing a linking module for stacking shipping cases to form a tower. The tower is preferably formed by positioning one of the cases on a supporting surface, attaching the linking module to the first case, inverting a second shipping case, and attaching the second case to the linking module.

The linking module has a set of openings formed therein that receive the top of the shipping case such that the cases are held in alignment and restricted from relative movement. The cases removably attach to the linking module such that the cases and linking module can be quickly and easily configured into a tower/kiosk.

In order to nest inside the linking module, the tops of the shipping cases extend beyond the body of the cases to form a shoulder. The shoulders of the cases fit inside the opening in the linking module. Accordingly, in order to fit the upper case into the linking module it is normally inverted.

The linking module provides for the connection of the cases but also provides additional features. The linking module can be constructed to form a spacer between the two cases and the space created may be used as a storage space. Depending on the length of the linking module, the linking module may also support a shelf attachment for supporting brochures, pamphlets, flyers, samples, and the like.

Accordingly, it is an object of the present invention to make use of shipping cases to form a tower suitable for use at a trade show.

It is another object of the invention to provide a shipping case to tower conversion capable of supporting decorative panels and/or graphics.

It is an additional object of the present invention to provide a shipping case to tower conversion that is economical and that does not require too much additional shipping space.

The following detailed description of the invention, when read in conjunction with the accompanying drawings wherein the same reference numerals denote the same or similar parts throughout the several views, is in such full, clear, concise, and exact terms as to enable any person skilled in the art to which it pertains, or with which it is mostly nearly connected, to make and use the invention.

DETAILED DESCRIPTION OF THE INVENTION

Figure 1:
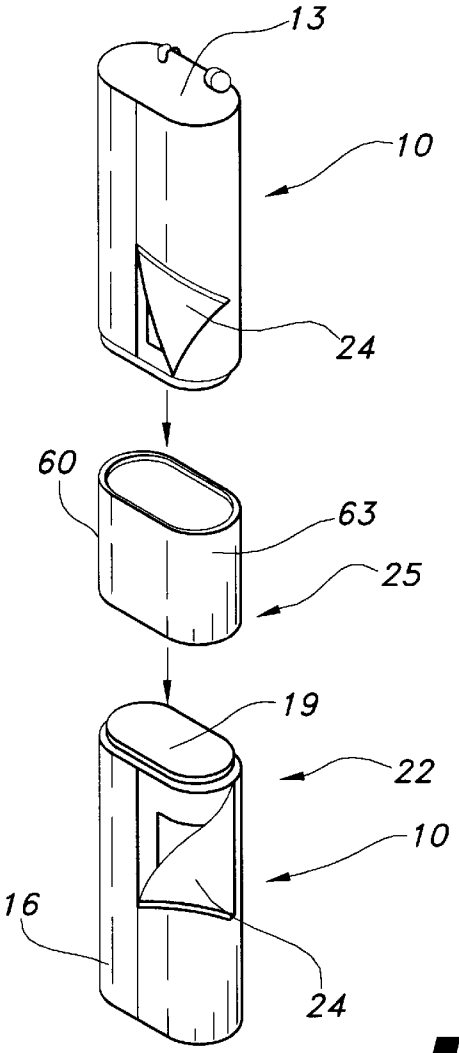
FIG. 1 is an exploded view of the stackable case to tower conversion of the present invention.

Referring to FIGS. 1–5, and initially to FIG. 1, a pair of enclosures 10 are shown. The enclosures 10 are preferably constructed of a durable, lightweight material such as a hard shell plastic. The enclosures are generally oval shaped and are tubular with a solid bottom wall 13, a tubular body 16 and a top 19. The top 19 is preferably formed such that it is wider than the body 16 to form a shoulder 22 (best shown in FIGS. 4–5). The enclosure 10 is of the type configured to enclose "pop-up" portable display structures, such as the ones shown in U.S. Pat. No. 4,658,560 to Beaulieu, and U.S. Pat. Nos. 4,986,016 and 5,125,205 to Wichman, the disclosures of which are incorporated herein by reference. Such pop-up displays are available in a variety of either full-size freestanding configurations (such as 10 feet high curved, 8 feet high curved, and full-size flatwall) or small table-top configurations (such as 8 feet high table-top, 6 feet high table-top, and 6 feet high flatwall). The enclosures 10 or shipping cases are used to store and to transport the pop-up displays for use at trade shows.

The enclosures 10 are preferably of the type that are capable of receiving decorative display panels 24 to convert from shipping cases to decorative podiums for use in trade shows as shown and described in the above-identified application Ser. No. 08/777,668.

The enclosures 10 can be stacked on top of one another and connected by a linking module 25. This concept and the present invention can be incorporated into any number of existing products in the marketplace especially within the display and exhibit arena.

Figure 2:
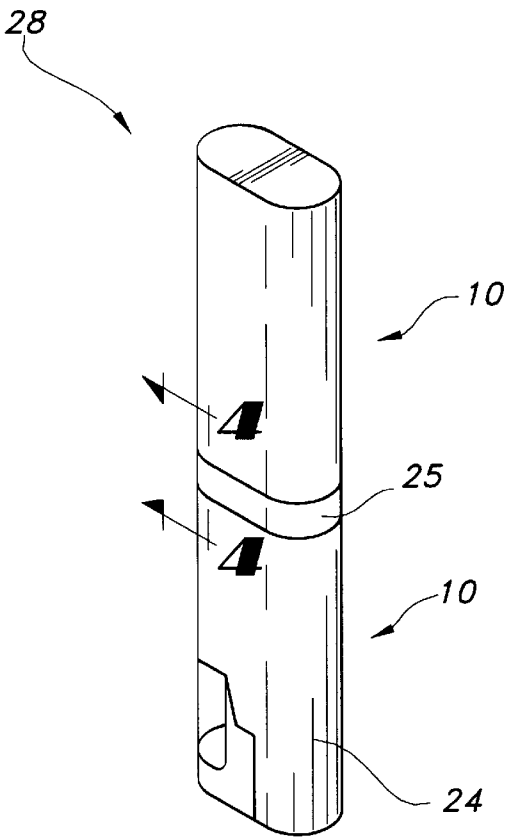
FIG. 2 is a perspective view of the stackable case to tower conversion of the present invention.

In FIG. 2, the enclosures 10 are stacked one on top of the other to form a tower 28. The enclosures 10 are connected by the linking module 25. The linking module 25 is preferably constructed out of molded plastic. The enclosures 10 and the linking module 25 are shown in the oval shaped configuration. Other shapes such as square, rectangle, and the like could also be used if suitable for a particular version of pop-up display structure. The decorative display panel 24 attaches around the enclosure 10.

Figure 3A:
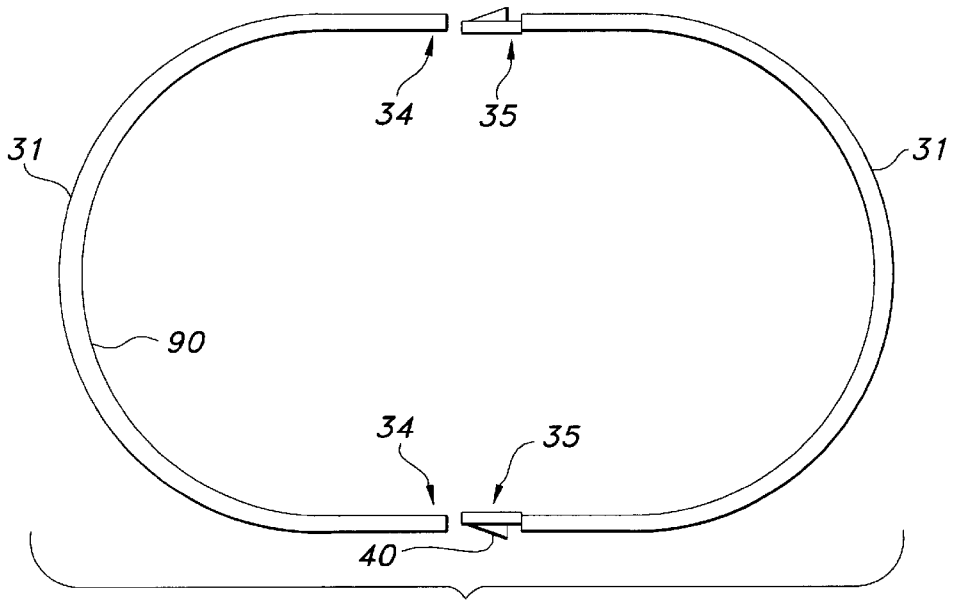
FIG. 3A is a top plan view of an alternate embodiment of the linking module of the present invention.
Figure 3B:
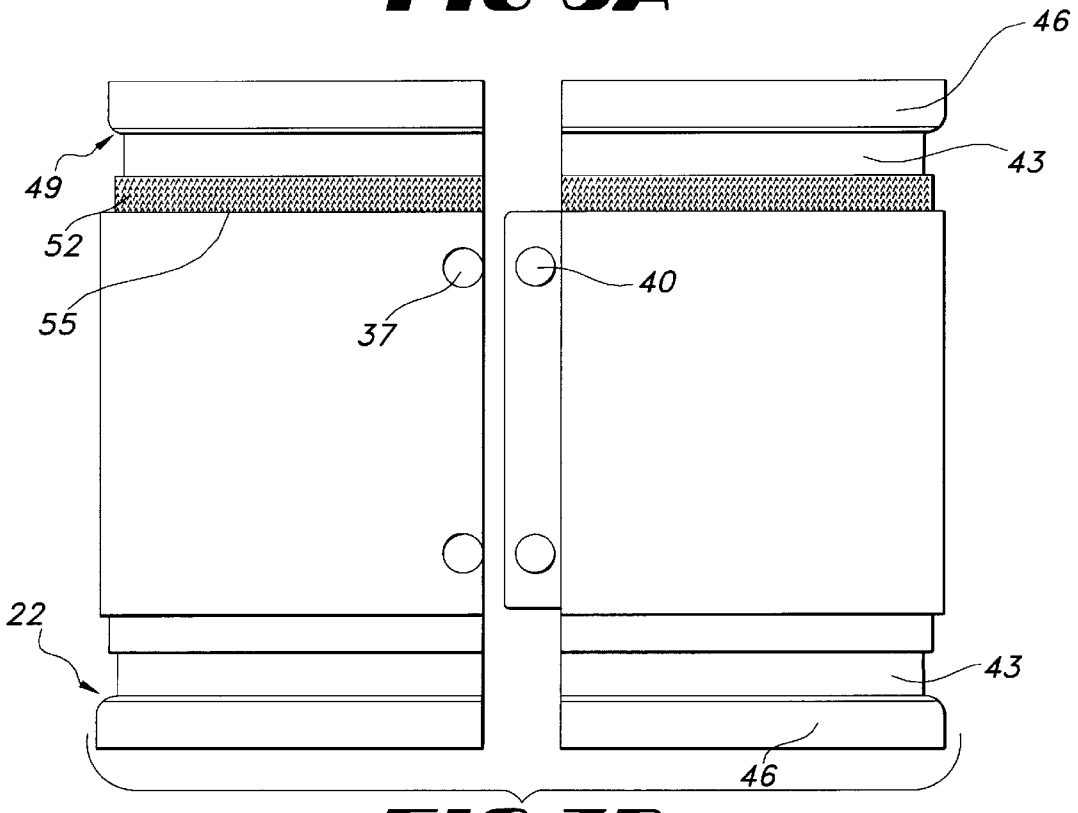
FIG. 3B is a front elevation view of the linking module shown in FIG. 3A.

Turning to FIG. 3A, an alternate embodiment of the linking module includes a two piece construction with two module members 31 that are preferably formed out of a molded plastic. The module members 31 connect along opposite edges 34 and 35 by means of cooperating apertures 37 and ramped buttons 40 (best shown in FIG. 3B). The ramped buttons 40 frictionally engage with the apertures 37 until they "snap" into position. As shown in FIG. 3B, the module members 31 have a necked down portion 43 that is disposed adjacent to a top portion 46. The top portion 46 preferably contains a projecting member 90 that engages with the enclosures 10. The top portion 46 has a greater width than the body of the case adjacent to the top portion 46 and forms a shoulder 49. The module members 31 also have a reduced width section 52 for mounting a hook and loop fastener 55. The decorative panel 24 may be engaged with the hook and loop fastener 55.

Figure 4:
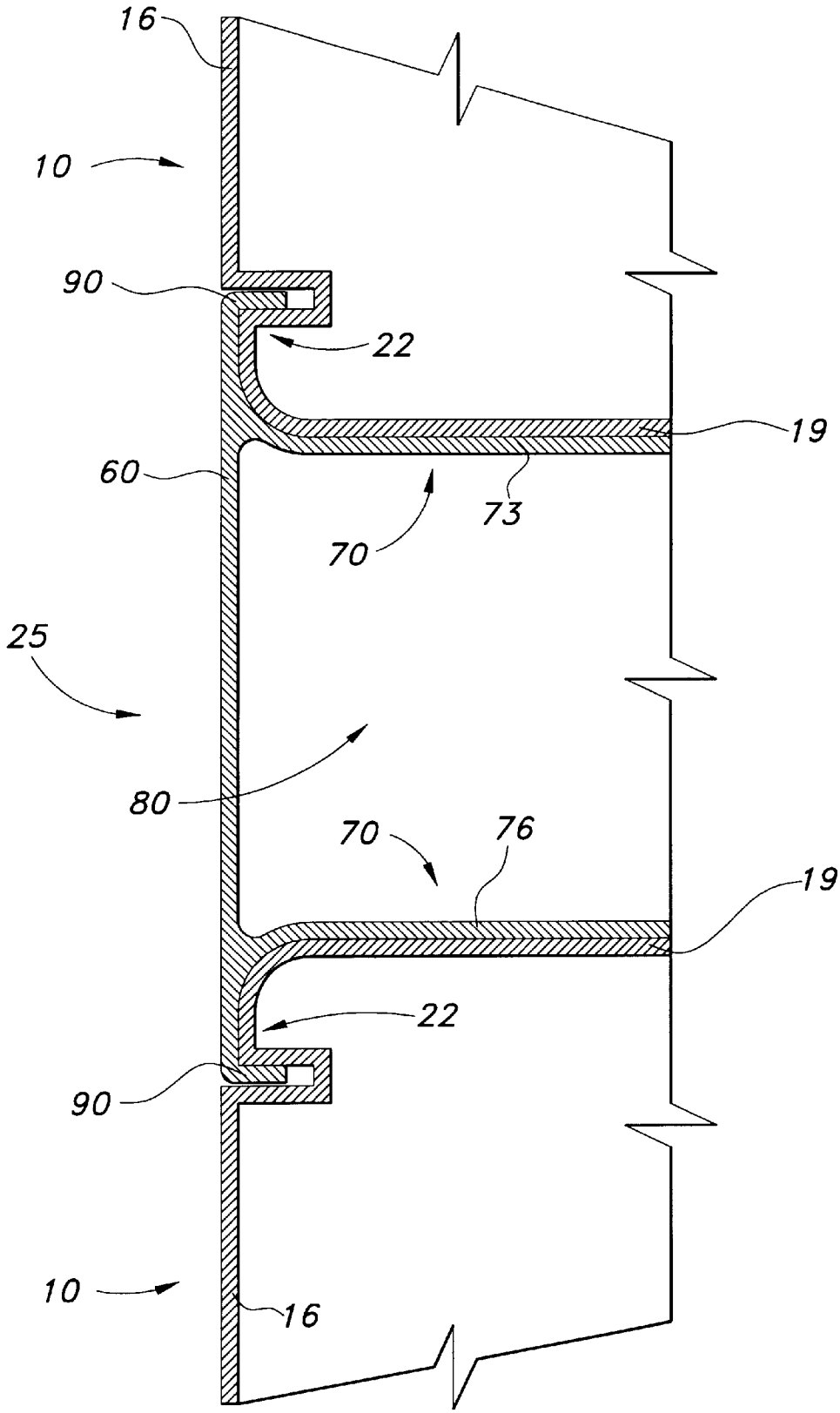
FIG. 4 is a partial sectional view taken in the dotted line area along sectional line 4—4 of FIG. 2.

Both the linking module 25 and the module members 31 attach to the enclosure 10 in the manner shown in FIG. 4. The module 25 includes a first side wall 60 and a second side wall 63 disposed opposite from the first side wall 60. Because both sides of the linking module 25 are the same, the invention is described with reference to one of the sides. The module 25 is preferably tubular shaped (best shown in FIG. 1) for reasons relating to stability and appearance. However, the module 25 does not have to be tubular and does not have to completely surround the top 19 of the enclosure 10.

A support member 70 preferably comprises a pair of spaced apart walls 73 and 76 that support the side walls 60 and 63 of the linking module 25. For tubular linking modules 25 that surround the top 19 (as shown in FIG. 1 and FIG. 3A) a support member 70 may be included but is not required.

The spaced apart walls 73 and 76 and the walls 60 and 63 define an interior space 80. The space 80 may be used for storing items such as flyers, brochures, pamphlets, pens, pads, calculators, notebook computers, and the like.

The side walls 60 and 63 have projecting members 90 extending therefrom. The projecting members 90 engage with the shoulder 22 of the enclosure 10 in order to hold the enclosures 10 in alignment and prevent relative movement between the enclosures 10. The projecting member 90 may be rigid, however, the rigid configuration requires an opening for the top 19 to slide into the channel formed by the projecting member 90. Accordingly, the projecting member 90 is preferably pliable such that the top 19 of the case can be frictionally fit into the space formed by the side wall 60, the first wall 73, and the projecting member 90.

Figure 5:
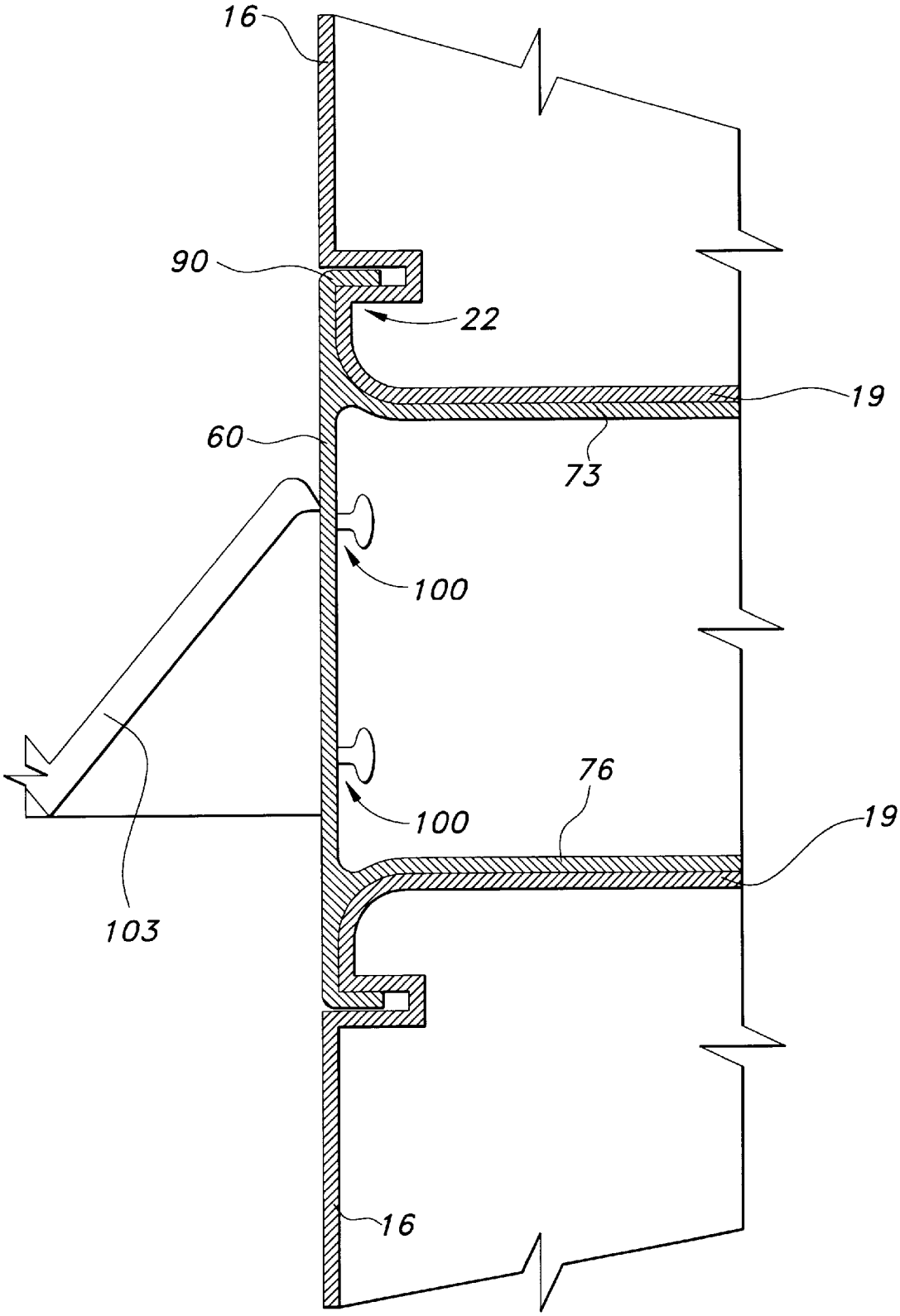
FIG. 5 is an alternate embodiment of FIG. 4.

As best shown in FIGS. 4 and 5, the projecting member 90 does not extend all the way to the body 16 at the point where the shoulder 22 engages with the projecting member 90. The resulting space makes it easier for the projecting member 90 to deform enough to let the top 19 frictionally fit into the linking module 25.

The frictional engagement enables the linking module 25 to completely surround the top 19 of the enclosure 10 which provides a smooth seam and a pleasing aesthetic appearance as best shown in FIG. 2.

Turning to FIG. 5, in an alternate embodiment, the first side wall 60 of the linking module 25 can be equipped with apertures 100 for supporting an attachment 103. The attachment 103 may comprise a shelf, container, support, and the like.

Accordingly, the present invention provides several advantages. First, given that there are many display products and systems in the marketplace that are specifically targeted towards the portable and modular exhibition portion of the industry, and that these products pack down compactly and ship in some type of case (FIG. 1), usually of molded plastic or fabricated, this invention provides for taking two of such types of cases and incorporating a linking module 25 that will allow the cases to be stacked vertically (FIG. 2). This linking module 25 may have the option of being shipped directly on the case during shipment. The stacking of these two cases will create a freestanding tower or kiosk unit which can be clad with graphics, fabric panels and the like.

Also, it is an advantage of the present invention that within this linking module there may be provisions for housing a shelving bracket, computer keyboards, or other related items which may be a benefit to the display/exhibitor or user of the invention. The finished kiosk/tower unit may also be used as a support mechanism to support suspended headers for attachment back to the display/exhibit backwall. Indeed it is within the scope of this invention to be utilized in this way with the current collapsible header frame unit described in the above-referenced patent application Ser. No. 08/777,668.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A linking module, comprising:

an oval-shaped tubular member having a first end and a second end;

a first projecting member extending inside the tubular member and disposed at the first end of the tubular member; and, a second projecting member extending inside the tubular member and disposed at the second end of the tubular member.

2. The linking module of claim 1, wherein the tubular member has an aperture defined therein.

3. The linking module of claim 2, further comprising an attachment capable of removably engaging with the aperture in the linking module.

4. A stackable case to tower conversion, comprising;

at least two enclosures having a top member and a body member, the top member extending beyond the body member to form a shoulder;

a linking module having a tubular member with a first end and a second end, a first projecting member extending inside the tubular member and disposed at the first end of the tubular member, a second projecting member extending inside the tubular member and disposed at the second end of the tubular member, the linking module capable of receiving the enclosures such that the shoulder of the enclosure engages with the projecting member on the linking module to hold the enclosures substantially in alignment.

5. The linking module of claim 4, further comprising a support member disposed inside the tubular member.

6. The linking module of claim 5, wherein the support member comprises a first wall disposed in spaced apart relation with a second wall such that the tubular member and the first and second wall define a space.

7. The stackable case to tower conversion of claim 4, wherein the projecting members are pliable such that the top of the enclosure is capable of frictionally fitting into the linking module.

8. The stackable case to tower conversion of claim 4, in combination with a framework for mounting displays which framework is collapsible for stowage inside one of the at least two enclosures.

9. The stackable case to tower conversion of claim 4, wherein each of the at least two enclosures further comprises a decorative panel for extending about the enclosure.

* * * * *